US007618297B2

(12) United States Patent
Wang

(10) Patent No.: US 7,618,297 B2
(45) Date of Patent: Nov. 17, 2009

(54) ELECTRICAL CONNECTOR WITH ANTI-MISMATING MECHANISM FOR PREVENTING INCORRECT INSERTION OF A SMALLER SIZED MATING CONNECTOR

(75) Inventor: Ning Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/218,430

(22) Filed: Jul. 14, 2008

(65) Prior Publication Data

US 2009/0017696 A1 Jan. 15, 2009

(30) Foreign Application Priority Data

Jul. 12, 2007 (CN) ..... 2007 2 0040736

(51) Int. Cl.
*H01R 24/00* (2006.01)

(52) U.S. Cl. ..... 439/676; 439/680

(58) Field of Classification Search ..... 439/660, 439/676, 677, 680
See application file for complete search history.

(56) References Cited

U.S. PATENT DOCUMENTS 4,781,626 A * 11/1988 Lazarchik ..... 439/680
6,851,984 B2 * 2/2005 Chang ..... 439/676
7,033,227 B2 * 4/2006 Karir ..... 439/676

FOREIGN PATENT DOCUMENTS

CN 2922185 Y 7/2007

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector (100) for permitting insertion of a full sized plug (200) and for preventing insertion of a smaller sized plug (300) includes an insulative housing (1) defining a receiving cavity (101) through a front face (10) thereof and a plurality of receiving grooves (12) extending in a mating direction of the plug at one inner side (11) of the receiving cavity and a plurality of terminals (2). Each terminal defines a fixing portion (21) received and retained in the receiving groove, a contacting portion (22) extending into the receiving cavity from a front end of the fixing portion and a soldering portion (23) extending from a rear end of the fixing portion. The electrical connector further defines at least one protrusion (121) discrete with the terminal, the at least one protrusion is in front of and aligns with one contacting portion of the outmost terminals.

4 Claims, 5 Drawing Sheets

ELECTRICAL CONNECTOR WITH ANTI-MISMATING MECHANISM FOR PREVENTING INCORRECT INSERTION OF A SMALLER SIZED MATING CONNECTOR

BACKGROUND OF THE INVENTION

1. Field of the Invention

The present invention relates to an electrical connector, and particularly to a modular jack designed to prevent an improper insertion of a smaller sized plug connector.

2. Description of the Prior Art

RJ-11 and RJ-45 receptacles respectively engaging with corresponding RJ-11 and RJ-45 plugs are commonly used in network communications. RJ-45 receptacles and plugs have larger dimensions than RJ-11 receptacles and plugs. Therefore, a RJ-11 plug or any smaller sized RJ type plug may be inadvertently inserted into a RJ-45 receptacle, which may result in damage to the terminals of the RJ-45 receptacle.

Chinese Patent Issued Number 2922185Y discloses a receptacle connector having means to prevent incorrect insertion of a smaller sized plug so as to protect terminals of the receptacle connector. The receptacle connector includes an insulative housing, a plurality of terminals received in the housing and a shell covering on the housing. The housing defines a receiving cavity for receiving a mating plug through a front face thereof. Each terminal defines a connecting portion, and the connecting portion defines a front end and a rear end. A contacting portion is defined between the front end and the rear end, and a blocking portion is defined on the front end aligned with the contacting portion. When an undersized plug is inserted into, the passages defined in the plug are not corresponding to the blocking portion, so that the blocking portion may block the front of the plug to prevent further insertion of the undersized plug.

But the blocking portion is just for a specific kind of terminals, and the forming process of the terminals is complicated, the cost is very high. Hence, a new design which can prevent incorrect insertion of a smaller sized mating connector is required.

SUMMARY OF THE INVENTION

Accordingly, an object of the present invention is to provide an electrical connector with simple anti-mismating mechanism for preventing an improper insertion of an undersized mating connector.

In order to achieve the object set forth, an electrical connector for permitting insertion of a full sized plug and for preventing insertion of a smaller sized plug includes an insulative housing defining a receiving cavity through a front face thereof and a plurality of receiving grooves extending in a mating direction of the plug at one inner side of the receiving cavity and a plurality of terminals. Each terminal defines a fixing portion received and retained in the receiving groove, a contacting portion extending into the receiving cavity from a front end of the fixing portion and a soldering portion extending from a rear end of the fixing portion. The electrical connector further defines at least one protrusion discrete with the terminal, the at least one protrusion is in front of and aligns with one contacting portion of the outmost terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
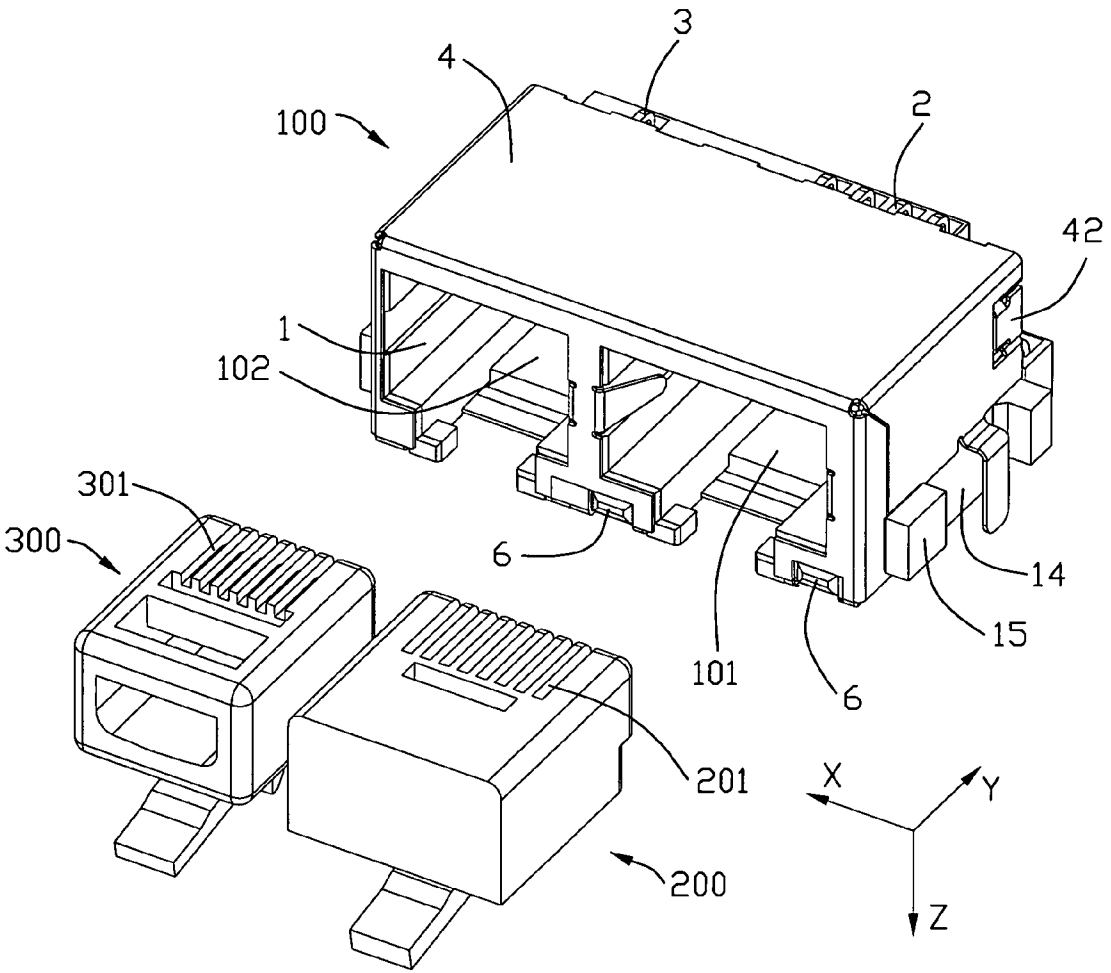
FIG. 1 is an assembled perspective view of an electrical connector and two mating connectors in accordance with a preferred embodiment of the present invention.

Reference will now be made to the drawing figures to describe a preferred embodiment of the present invention in detail.

Figure 2:
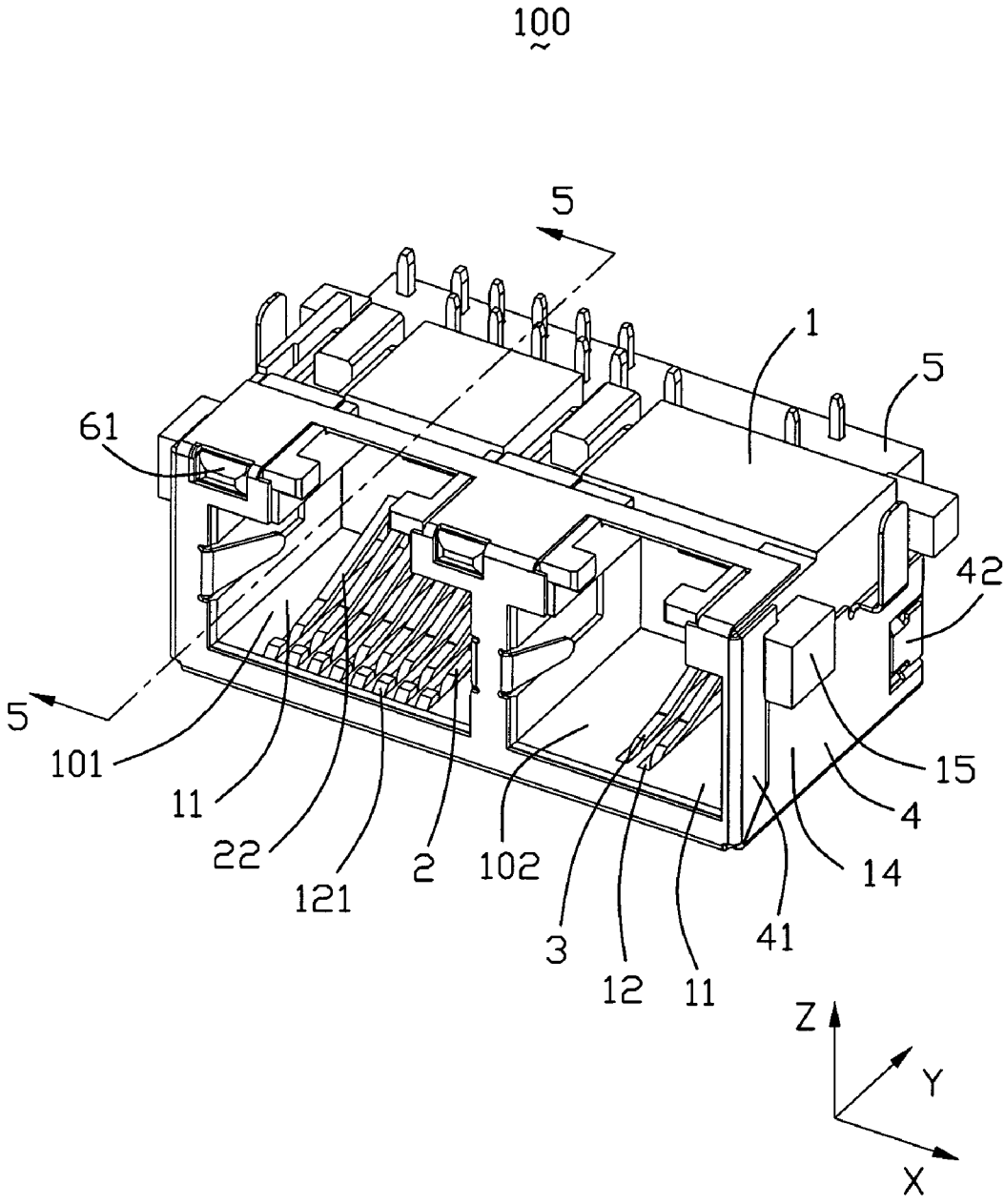
FIG. 2 is another perspective view of the electrical connector.

Referring to FIG. 1 and FIG. 2, the electrical connector 100 described in this preferred embodiment is a receptacle connector assembly for receiving two types of mating plugs 200, 300. The electrical connector 100 includes an insulative housing 1, a plurality of first and second terminals 2, 3 received in the housing 1 and a shell 4 covering the housing 1.

Figure 3:
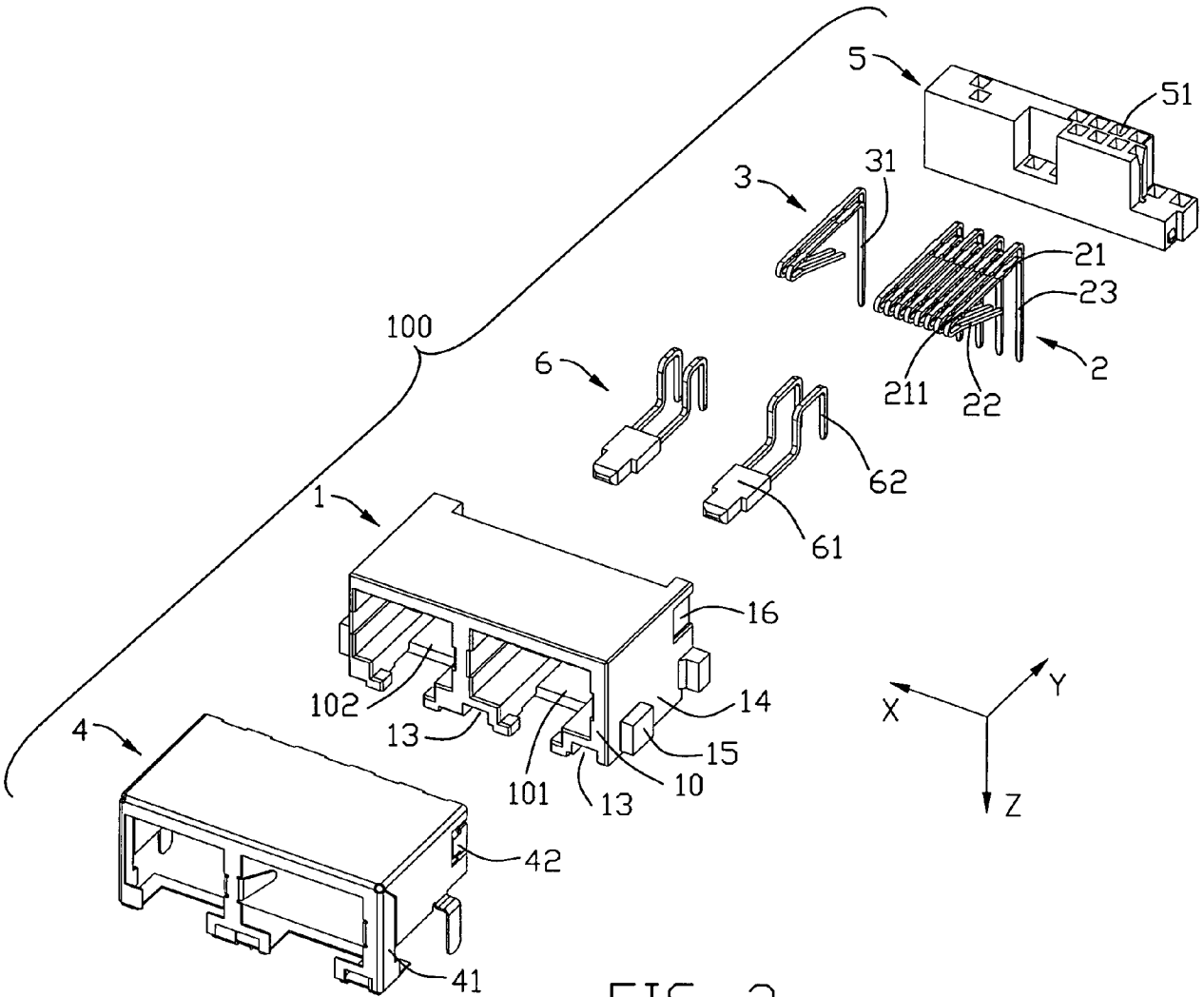
FIG. 3 is an exploded view of the electrical connector.
Figure 5:
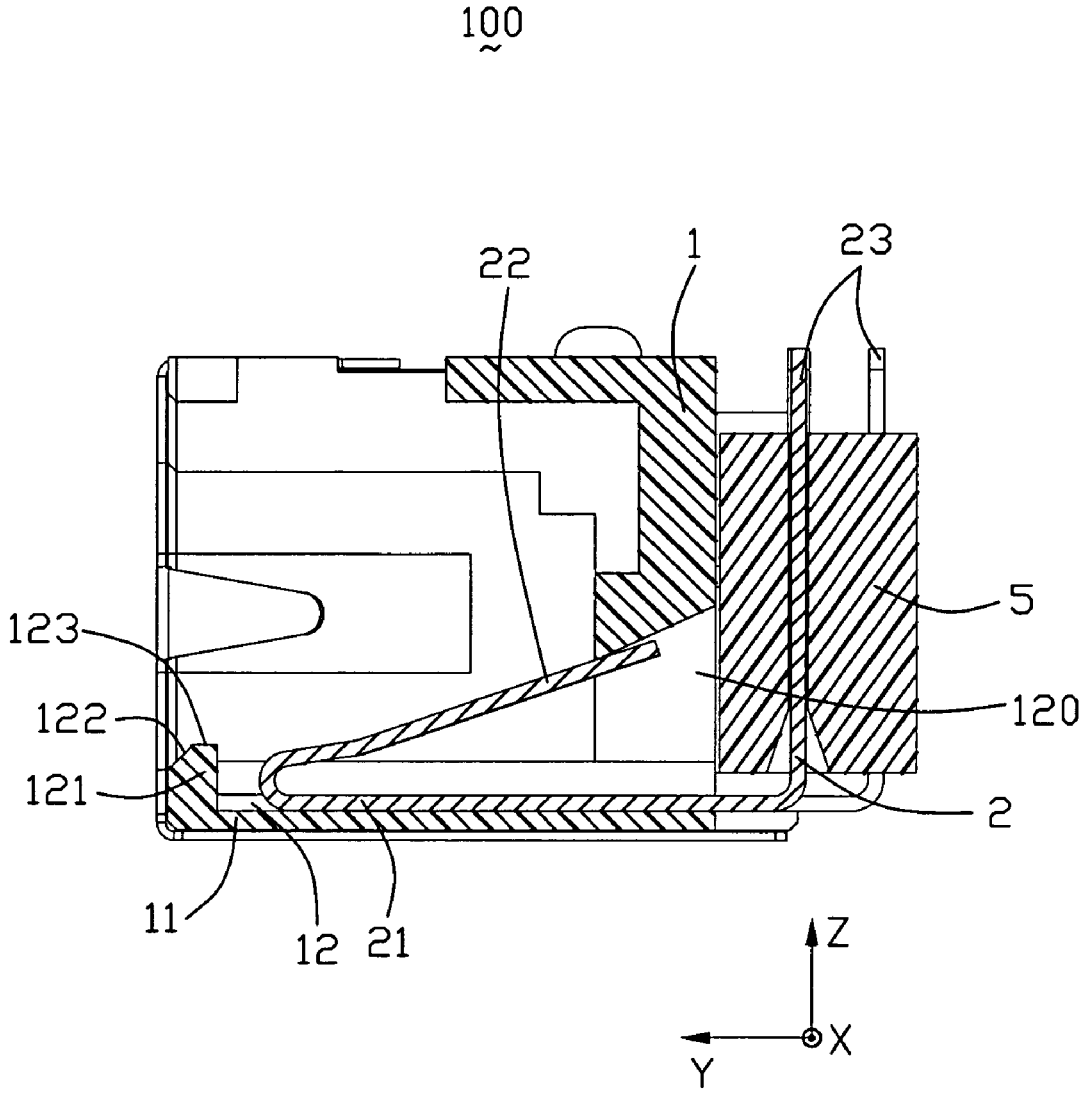
FIG. 5 is a cross sectional view taken along line 5-5 of FIG. 2.

Referring to FIG. 2 and FIG. 3, the insulative housing 1 defines a front face 10 as a mating face. The housing 1 defines a first receiving cavity 101 for receiving a RJ-45 plug 200 and a second receiving cavity 102 for receiving a smaller RJ-11 plug 300 through the mating face 10 thereof. The two receiving cavity 101, 102 are arranged side by side along a first direction ("X" direction). The housing 1 further defines a plurality of receiving grooves 12 in communication with the receiving cavity 101, 102 for accommodating the terminals 2, 3 at an inner side 11 of the receiving cavity 101, 102 thereof along an inserting direction of a mating plug ("Y" direction, a second direction, a mating direction). A plurality of protrusions 121 discrete with the first terminals 2, are arranged along the X direction in the first receiving cavity 101. The protrusions 121 are integrally extending upwards from the inner side 11 of the housing 1 and in front of the receiving groove 12. The protrusions 121 are aligned with the receiving grooves 12 one by one. Each of the protrusions 121 defines a guiding face 122 slanting into the first receiving cavity 101 and a supporting face 123 (as FIG. 5 shown) vertically to a third direction ("Z" direction) vertical to the first and second direction. The supporting face 123 connects with the guiding face 122. A space is formed between every two adjacent protrusions 121.

Figure 4:
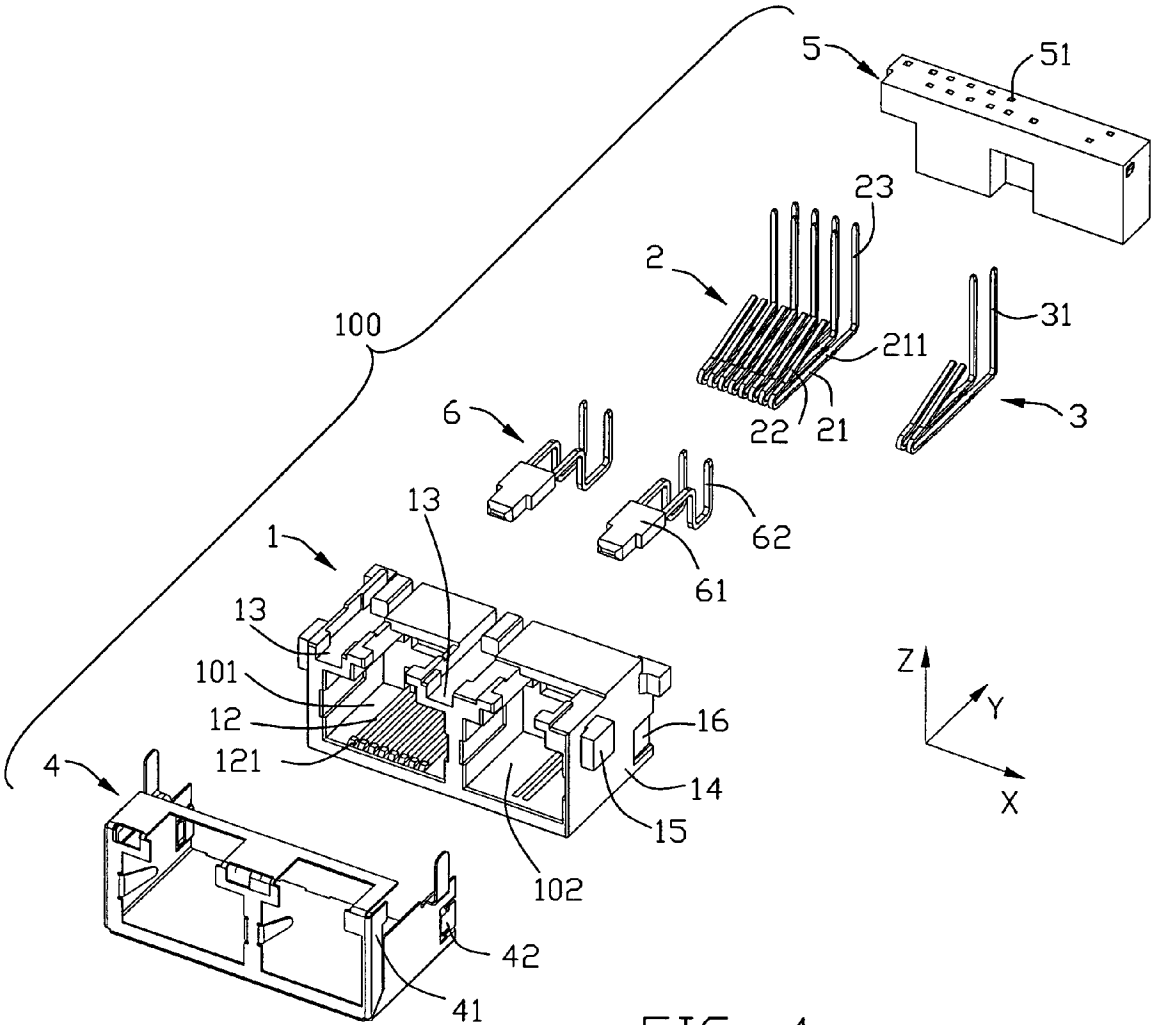
FIG. 4 is another view of the electrical connector shown in FIG. 3.

Referring to FIG. 3 to FIG. 5, the first terminals 2 are received in the first receiving cavity 101, the second terminals 3 are received in the second receiving cavity 102. Each of the first terminals 2 defines a horizontal fixing portion 21 received in the receiving groove 12, an elastic contacting portion 22 extending rearwards at an acute angle from a front end of the fixing portion 21 and a soldering portion 23 extending vertically and upwardly from a rear end of the fixing portion 21. The protrusions 121 are aligned with the corresponding contacting portion 22 received in receiving grooves 12 in the Y direction. During assembly, the first terminals 2 are inserted into the housing 1 along a back-to-front direction through an opening 120 defined in a rear wall of the housing 1. Each fixing portion 21 is retained in the corresponding receiving groove 12 with the protrusions 211 engaging with the receiving groove 12. The elastic contacting portions 22 extend upwardly and rearwards into the first receiving cavity 101 for engaging with a mating plug and the free ends thereof is blocked by the top of the opening 120. The soldering portions 23 extend out of the housing 1 and run through a retaining member 5 along the Z direction. The second terminals 3 have the same configuration as the first terminals 2, and each of the second terminals 3 defines a soldering portion 31 extending out of the housing 1.

Referring to FIG. 3 and FIG. 4, the insulative housing 1 defines a pair of retaining slots 13 running through the top surface. A pair of lighting devices 6 are received in the retaining slots 13. Each lighting device 6 defines a LED portion 61 retained in the retaining slot 13 and a pair of soldering portions 62 running through the retaining member 5 retained on the rear wall of the housing 1. The retaining member 5 defines a plurality of slots 51 running through the top and bottom surface in the Z direction, and the soldering portions 62 run through the retaining member 5 from the corresponding slots 51 to prevent from being destroyed during assembly and soldering as the soldering portions 23, 31 of the terminals 2, 3. The shell 4 covers on the housing 1 with a pair of retaining portions 41 retained in the retaining blocks 15 defined on the sidewall 14 of the housing 1 and a pair of elastic portions 42 abutting against the indentation 16 (as FIG. 2 shown).

When a RJ-45 plug 200 is inserted into the first receiving cavity 101, the passages 201 (as FIG. 1 shown) defined in front of the RJ-45 plug 200 are corresponding to the contacting portions 22 one by one and are guided by the protrusions 121 to ensure the full sized plug 200 further entering into the first receiving cavity 101.

The RJ-11 plug 300 has six passages 301, which are less one than the RJ-45 plug 200 with eight passages 201 at opposite ends along the X direction respectively. When the smaller RJ-11 plug 300 is inserted into the first receiving cavity 101, at least two protrusions 121 respectively at outmost ends of the terminals 2 arranging in the X direction will block two side portions of the RJ-11 plug 300 to prevent the smaller RJ-11 plug 300 from entering into the first receiving cavity 101. The two terminals arranging at opposite ends along the X direction are the outmost terminals. The insulative protrusions 121 defined in the insulative housing 1 are strong enough to prevent an incorrect insertion of a smaller sized mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for permitting insertion of a full sized plug and for preventing insertion of a smaller sized plug, comprising:

an insulative housing defining a receiving cavity through a front face thereof and a plurality of receiving grooves extending in a mating direction of the plug at one inner side of the receiving cavity; and a plurality of terminals, each terminal defining a fixing portion received and retained in the receiving groove, an elastic contacting portion extending into the receiving cavity from a front end of the fixing portion and a soldering portion extending from a rear end of the fixing portion;

wherein the electrical connector defines at least one protrusion discrete with the terminal for blocking a side portion of the smaller sized plug, and the at least one protrusion aligns with one contacting portion of the outermost terminal;

wherein the least one protrusion is positioned in front of the receiving groove for receiving the outermost terminal therein, and the at least one protrusion extends upward without any portion disposed above the receiving groove and the corresponding contacting portion;

wherein the at least one protrusion is integrally extending upwards from an inner side of the housing;

wherein the at least one protrusion defines a guiding face slanting to the receiving cavity and a supporting face connecting with the guiding face and in front of the receiving groove;

wherein the terminal defines a lying U-shaped structure behind the corresponding protrusion; and wherein said terminal further includes a straight contact section extending from said U-shaped structure in an oblique direction, and a joint of said straight contact section and said U shaped structure is lower than said protrusion.

2. The electrical connector as described in claim 1, wherein the at least one protrusion is aligned with the receiving groove one by one.

3. The electrical connector as described in claim 1, wherein the full sized plug defines a passage corresponding to the at least one protrusion.

4. The electrical connector as described in claim 1, wherein the electrical connector further defines a retaining member, and the retaining member defines a plurality of slots for receiving the soldering portions.

* * * * *